US007242137B2

(12) United States Patent
Masumura

(10) Patent No.: US 7,242,137 B2
(45) Date of Patent: Jul. 10, 2007

(54) CATHODE RAY TUBE WITH CONE HAVING NON-CIRCULAR CROSS-SECTION

(75) Inventor: Tetsuya Masumura, Suita (JP)

(73) Assignee: Matsushita Toshiba Picture Display Co., Ltd., Osaka (JP)

( * ) Notice: Subject to any disclaimer, the term of this patent is extended or adjusted under 35 U.S.C. 154(b) by 0 days.

(21) Appl. No.: 11/141,379

(22) Filed: May 31, 2005

(65) Prior Publication Data

US 2006/0066206 A1 Mar. 30, 2006

(30) Foreign Application Priority Data

Sep. 30, 2004 (JP) ..... 2004-288009

(51) Int. Cl.
*H01J 29/86* (2006.01)
*H01J 29/70* (2006.01)
*H01J 5/24* (2006.01)
*H01J 61/30* (2006.01)

(52) U.S. Cl. ..... 313/477 R; 220/2.1 A; 220/2.1 R

(58) Field of Classification Search ..... 313/477 R, 313/440; 220/2.1 R, 2.1 A
See application file for complete search history.

(56) References Cited

U.S. PATENT DOCUMENTS

| | | | |
|---|---|---|---|
| 3,731,129 | A | 5/1973 | Tsuneta et al. |
| 4,677,339 | A | 6/1987 | Inoue et al. |
| 5,506,466 | A | 4/1996 | Shoda et al. |
| 5,633,558 | A | 5/1997 | Watanabe et al. |
| 6,002,203 | A | 12/1999 | Yokota et al. |
| 6,025,676 | A | 2/2000 | Ohama et al. |
| 6,335,588 | B1 | 1/2002 | Kim et al. |
| 6,465,945 | B1 | 10/2002 | Tsuchida et al. |
| 6,583,546 | B2 | 6/2003 | Nah |
| 6,650,036 | B2 | 11/2003 | Nakagawa et al. |
| 2002/0014820 | A1 | 2/2002 | Jung |
| 2002/0109451 | A1 | 8/2002 | Nakagawa et al. |
| 2004/0000860 | A1 | 1/2004 | Jung |
| 2004/0164663 | A1 | 8/2004 | Kim |

FOREIGN PATENT DOCUMENTS

| | | |
|---|---|---|
| EP | 0 831 515 | 3/1998 |
| EP | 0 926 697 | 6/1999 |

(Continued)

*Primary Examiner*—Mariceli Santiago
*Assistant Examiner*—Peter Macchiarolo
(74) *Attorney, Agent, or Firm*—Hamre, Schumann, Mueller & Larson, P.C.

(57) ABSTRACT

When we let the aspect ratio of the fluorescent screen of a cathode ray tube be M:N and, in a coordinate system in which the origin is a point on the tube axis and the horizontal axis and vertical axis intersect at right angles, when we let LA be the horizontal radius of the outer surface of a cone component 4, SA be the vertical radius, and θ be the angle formed by a horizontal axis H and an axis D in the direction of the maximum diameter on the inner surface of the cone component 4, then when the position Z on the tube axis, using as its origin a reference line position that serves as a reference for a deflection angle, is within a range of −30 mm≦Z≦10 mm, a portion is included such that the angle θ and the values of M, N, LA(Z), and SA(Z) satisfy the relational formula $\theta=\tan^{-1}[(N/M)\times(LA(Z)/SA(Z))]$.

9 Claims, 8 Drawing Sheets

FOREIGN PATENT DOCUMENTS

| | | |
|---|---|---|
| EP | 0 989 582 | 3/2000 |
| EP | 1 253 617 | 10/2002 |
| EP | 1 258 904 | 11/2002 |
| GB | 1 546 889 | 5/1979 |
| JP | 48-34349 | 10/1973 |
| JP | 51-118956 | 10/1976 |
| JP | 59-165341 | 9/1984 |
| JP | 60-177534 | 9/1985 |
| JP | 6-275206 | 9/1994 |
| JP | 7-161306 | 6/1995 |
| JP | 8-153467 | 6/1996 |
| JP | 9-82236 | 3/1997 |
| JP | 9-320492 | 12/1997 |
| JP | 10-199436 | 7/1998 |
| JP | 2000-113840 | 4/2000 |
| JP | 2000-243317 | 9/2000 |
| JP | 2001-60443 | 3/2001 |
| JP | 2001-351540 | 12/2001 |
| JP | 2002-245948 | 8/2002 |
| JP | 2002-313255 | 10/2002 |
| JP | 2004-31305 | 1/2004 |
| JP | 2004-273133 | 9/2004 |
| WO | 03/105180 | 12/2003 |

CATHODE RAY TUBE WITH CONE HAVING NON-CIRCULAR CROSS-SECTION

BACKGROUND OF THE INVENTION

1. Field of the Invention

The present invention relates to a cathode ray tube in which a deflection yoke is installed, and more particularly relates to a cathode ray tube capable of effectively reducing the deflection power.

2. Description of Related Art

An example of a conventional cathode ray tube will be described with reference to FIG. 12. FIG. 12 is a cross-sectional view of a cathode ray tube 20 according to a conventional example. A vacuum envelope 21 comprises a glass panel 22 whose display component is substantially rectangular, a glass funnel 23 whose large-diameter portion is linked to this panel 22, and a cylindrical, glass neck component 25 that is linked to a cone component 24 of this funnel 23.

A fluorescent screen 26 formed from a layer of fluorescent material is provided on the inner surface of the panel 22. This fluorescent layer comprises a striped or dotted three-color fluorescent layer for emitting red, green, and blue light. A shadow mask 27 is disposed across from the fluorescent screen 26. Numerous electron beam passage holes are formed in the shadow mask 27. An electron gun 28 that emits three electron beams is provided inside the neck component 25.

A deflection yoke 29 is installed from the outside of the cone component 24 of the funnel 23 to the outside of the neck component 25. The three electron beams are deflected by horizontal and vertical deflection magnetic fields generated by the deflection yoke 29, then are scanned through the shadow mask 27 horizontally and vertically over the fluorescent screen 26, which results in the display of a color image.

One type of cathode ray tube that is often put to practical use is a self-converging inline type of cathode ray tube. With this cathode ray tube, the electron gun 28 has an inline configuration and emits three electron beams that are disposed inline on the same horizontal plane. The horizontal deflection magnetic field generated by the deflection yoke 29 is pincusion-shaped, the vertical deflection magnetic field is barrel-shaped, and the three inline electron beams are deflected by these horizontal and vertical deflection magnetic fields, so that there is no need for a special correction system, and the three inline electron beams can be converged over the entire screen surface.

With a cathode ray tube such as this, the deflection yoke 29 consumed a great deal of electrical power, and lowering the power consumption of the deflection yoke 29 was key to reducing the power consumption of the cathode ray tube. Meanwhile, the anode voltage that ultimately accelerates the electron beams must be raised in order to increase the brightness of the screen. Also, the deflection frequency has to be raised in order to accommodate HD (high definition) TV or personal computers and other such office automation equipment. All of this results in greater deflection power.

In general, deflection power is reduced by decreasing the diameter of the neck component 25 of the cathode ray tube 20, and decreasing the outside diameter of the cone component 24 where the deflection yoke 29 is installed, so that deflection magnetic field operates more efficiently with respect to the electron beams. In this case, the electron beams pass in close proximity to the inner surface of the cone component 24 where the deflection yoke 29 is installed.

Accordingly, when the diameter of the neck component 25 or the outside diameter of the cone component 24 is further reduced, a phenomenon called BNS (beam neck shadow) occurs. This is a phenomenon in which an electron beam deflected at the maximum deflection angle toward one of the diagonal corners of the fluorescent screen 26 collides with the inner wall of the cone component 24, and part of the electron beam fails to reach the fluorescent screen 26 because of the shadow of the inner wall of the funnel 23 (hereinafter this phenomenon will be referred to as "beam neck shadow").

JP S48-34349B proposes a technique for solving this problem, in which the cone component 24 where the deflection yoke 29 is installed has a shape that progressively changes from being circular to being substantially rectangular in the panel 22 direction from the neck component 25 side. This arose from the idea that when a rectangular raster is drawn on the fluorescent screen 26, the region through which the electron beams pass on the inside of the cone component 24 is also substantially rectangular.

When the cone component 24 where the deflection yoke 29 is installed is formed in a pyramidal shape, the inside diameter of the diagonal corners where an electron beam is likely to collide (near the diagonal axis: near the D axis) is increased with respect to the ordinary circular shape, so as to avoid electron beam collisions. Deflection power can also be reduced by decreasing the inside diameters in the horizontal axis (H axis) and vertical axis (V axis) directions, so that the horizontal and vertical deflection coils of the deflection yoke are closer to the electron beams, allowing the electron beams to be deflected more efficiently.

However, with a cathode ray tube such as this in which the cross sectional shape of the cone component is substantially rectangular, the closer the cross sectional shape of the cone component is to being rectangular, the more the air pressure resistance of the vacuum envelope decreases, and safety is compromised. Therefore, for practical purposes the shape must be suitably rounded, in which case the problem is that there is no longer any reduction in deflection power.

In regard to this problem, in JP H9-320492A, as the external shape, and sometimes the internal shape as well, of the cone component progressively changes from the neck side in the panel direction from being circular to being a non-circular shape having its maximum diameter in a direction other than the first and second axial directions, and in a coordinate system in which the tube axis includes the origin and the first and second axes intersect at right angles, the angle formed by either of the two orthogonally intersecting axes at a position on the maximum diameter varies with the position on the tube axis.

When we let $\theta$ be the angle formed by the first axis at a position on the maximum diameter, and N/M be the ratio between the first axial direction and the second axial direction of the fluorescent screen, the shape is such that $\tan\theta \neq N/M$. Further, the shape is such that tang is closer to 1 than the value of the ratio N/M of the ratio between the first axial direction and the second axial direction of the fluorescent screen.

JP 2000-243317A proposes a technique for improving the magnetic field generation efficiency of a deflection yoke by making the cross sectional shape of the cone component taller than the aspect ratio of the screen in a cathode ray tube in which the cross sectional shape of the cone component is substantially rectangular.

However, the shape discussed in the above-mentioned JP H9-320492A is such that the angle formed by either of the two orthogonally intersecting axes at a position on the maximum diameter varies with the position on the tube axis. Consequently, the diagonal shape of the cone component becomes complex, the glass thickness distribution of the diagonal corners also becomes complex, and it is difficult to ensure adequate air pressure resistance. Also, the angle θ formed by the first axis at a position on the maximum diameter has a wide specified range, and when a shape is attempted such that the value of θ is closer to 1 than N/M, there will also be a region in which deflection power increases, and it is difficult to set the angle θ properly.

According to the construction of JP 2000-243317A, deflection magnetic field efficiency can be improved by making the aspect ratio of the cross sectional shape of the cone component taller than the aspect ratio of the screen. Here, the angle θ formed by the horizontal axis and a position on the maximum diameter of the inner surface of the cone component is not the proper angle at which beam neck shadow can be prevented, so preventing beam neck shadow and reducing deflection power are mutually exclusive. Furthermore, when the cross sectional shape of the cone component is too much taller than the aspect ratio of the screen, this too can lead to an increase in deflection power, so that it is difficult to set the angle θ properly.

An objective of the present invention is to solve these problems encountered in the past, and to provide a cathode ray tube with which air pressure resistance is ensured and beam neck shadow is prevented when the deflection magnetic field of the deflection yoke is closer to the electron beams. This would allow the electron beams to be deflected more efficiently, and reduce deflection power.

SUMMARY OF THE INVENTION

To achieve the stated object, the cathode ray tube of the present invention is a cathode ray tube, comprising a vacuum envelope equipped with an electron gun and including a panel component which has a fluorescent screen formed on a inner surface, and a deflection yoke disposed around the outer periphery of the vacuum envelope, for deflecting electron beams emitted from the electron gun. The vacuum envelope includes a neck component in which the electron gun is installed, and a cone component corresponding to the position where the deflection yoke is disposed. The cross sectional shape of the cone component in a direction perpendicular to the tube axis of the cathode ray tube includes a non-circular cross sectional shape having its maximum diameter in a direction other than those of the major and minor axes of the panel. The screen aspect ratio, which is the ratio of the horizontal diameter to the vertical diameter of the fluorescent screen, is termed M:N, in a coordinate system in which the origin is a point on the tube axis and the horizontal axis and vertical axis intersect at right angles, LA is the radius of the outer surface of the cone component on the horizontal axis, SA is the radius on the vertical axis, and θ is the angle formed by the horizontal axis and the axis in the direction of the maximum diameter on the inner surface of the cone component. When values of LA and SA are LA(Z) and SA(Z) when the position Z on the tube axis, using as its origin a reference line position that serves as a reference for a deflection angle, is within the range of $-30\ \text{mm} \leqq Z \leqq 10\ \text{mm}$, a portion is included such that the angle θ and the values of M, N, LA(Z), and SA(Z) satisfy the following relational formula: $\theta = \tan^{-1}[(N/M) \times (LA(Z)/SA(Z))]$.

DETAILED DESCRIPTION OF THE INVENTION

With the cathode ray tube of the present invention, air pressure resistance is ensured and beam neck shadow is prevented while the effect of increasing horizontal deflection efficiency is enhanced, which in turn enhances the effect of reducing deflection power.

With the cathode ray tube of the present invention, it is preferable that LA(Z)/SA(Z) in determining the angle θ is within the range of $1.01 \leqq LA(Z)/(SA(Z) \leqq 1.25$.

It is also preferable that the angle θ and the values of M, N, LA(Z), and SA(Z) satisfy said relational formula within the range of $-30\ \text{mm} \leqq Z \leqq 10\ \text{mm}$.

With the cathode ray tube of the present invention, it is preferable that the portion that satisfies the relational formula is such that the position Z is within the range of $-15\ \text{mm} \leqq Z \leqq 10\ \text{mm}$. This constitution is particularly well suited to preventing beam neck shadow.

It is also preferable that the angle θ and the values of M, N, LA(Z), and SA(Z) satisfy the relational formula within the range of $-15\ \text{mm} \leqq Z \leqq 10\ \text{mm}$.

With the cathode ray tube of the present invention, it is preferable that IA(Z)/SA(Z) in determining the angle θ is within the range of $1.15 \leqq LA(Z)/SA(Z) \leqq 1.25$. This construction is advantageous in terms of reducing deflection power.

With the cathode ray tube of the present invention, when ϕ is the maximum deflection angle of the electron beam that reaches the maximum diameter position of the fluorescent screen, then it is preferable that $\phi$ is within the range of $\phi \geqq 115°$. This construction is suited to preventing beam neck shadow and reducing deflection power.

Figure 1:
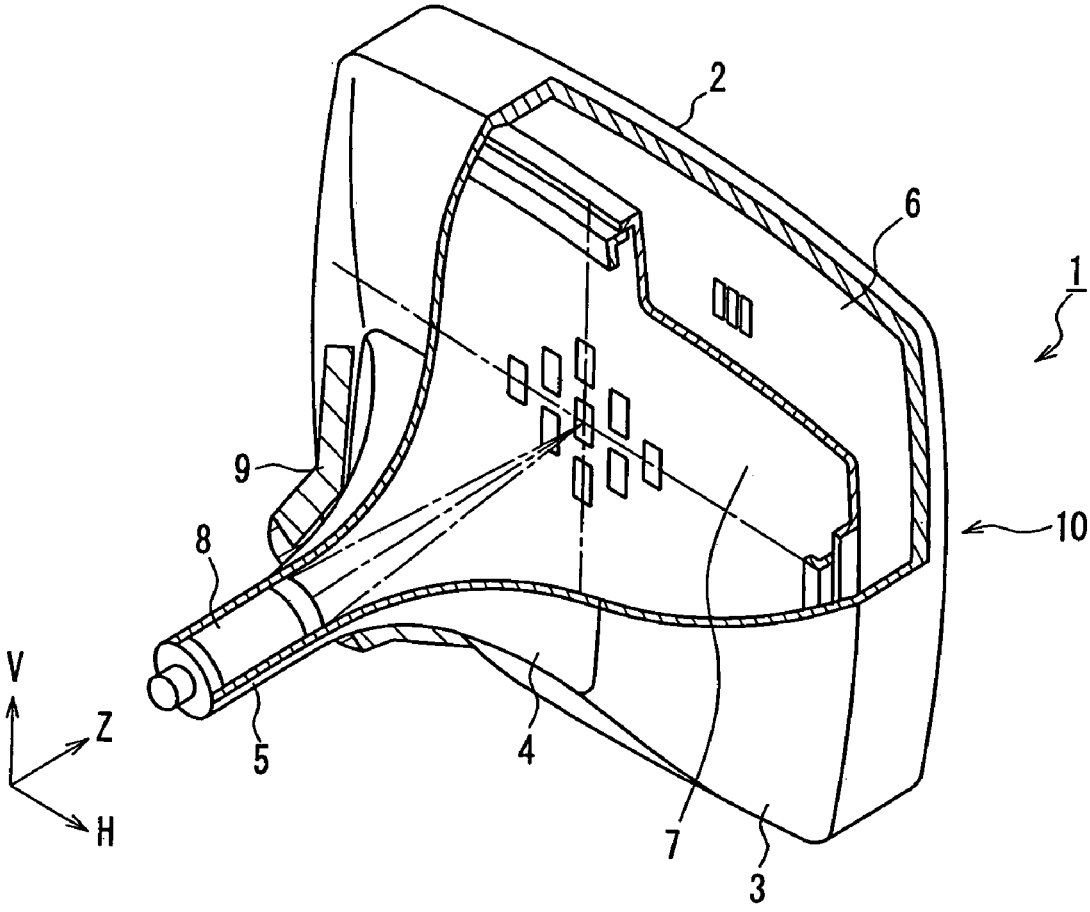
FIG. 1 is a perspective view of the external appearance and internal structure of the cathode ray tube according to an embodiment of the present invention.
Figure 2:
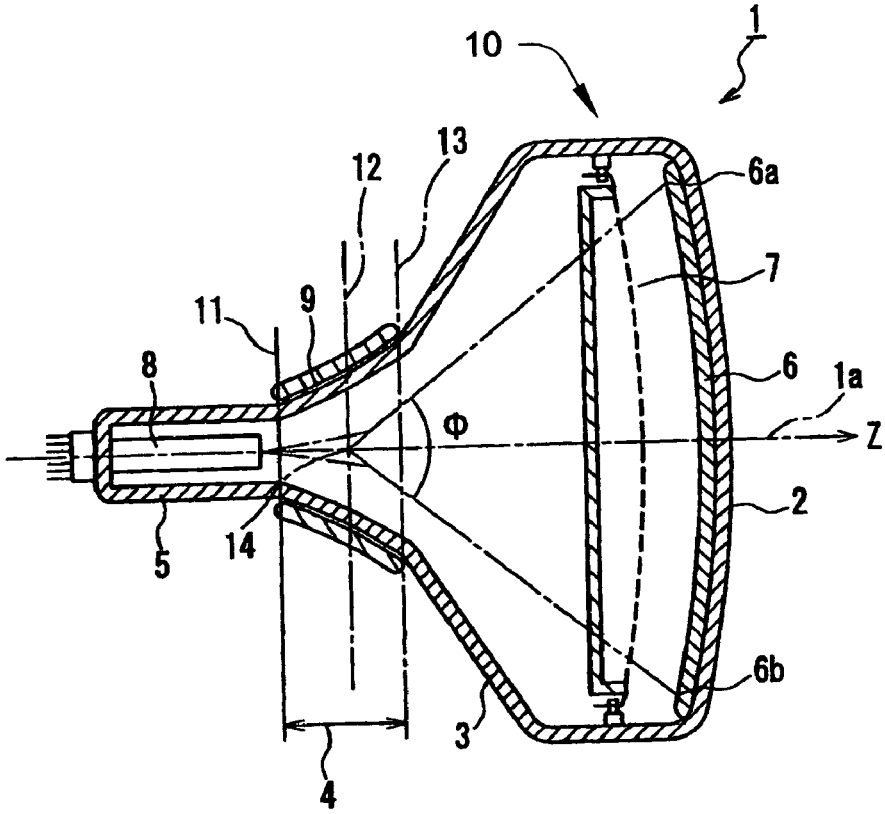
FIG. 2 is a cross-sectional view of the cathode ray tube according to an embodiment of the present invention.
Figure 3:
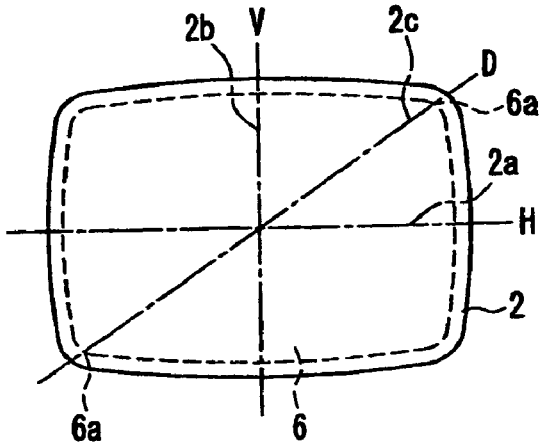
FIG. 3 is a plan view of a panel 2 of the cathode ray tube shown in FIG. 2.

An embodiment of the present invention will now be described through reference to the drawings. FIG. 1 is a perspective view of the external appearance and internal structure of the cathode ray tube according to an embodiment of the present invention. FIG. 2 is a cross-sectional view of the cathode ray tube according to an embodiment of the present invention. FIG. 3 is a plan view of a panel 2 of the cathode ray tube shown in FIG. 2.

AB shown in FIG. 1, a cathode ray tube 1 comprises a vacuum envelope 10. The vacuum envelope 10 includes a rectangular panel 2 in which the horizontal axis H is the long axis and the vertical axis V is the short axis, a funnel-shaped funnel 3 that is linked to the panel 2, and a cylindrical neck component 5 that is linked to the funnel 3.

A screen 6 formed from a layer of fluorescent material is provided on the inner surface of the panel 2. The fluorescent layer comprises a striped or dotted three-color fluorescent layer for emitting red, green, and blue light. A shadow mask 7 is disposed across from the screen 6. Numerous electron beam passage holes are formed in the shadow mask 7. An electron gun 8 that emits three electron beams is provided inside the neck component 5.

A deflection yoke 9 is installed on the cone component 4, which spreads out toward the panel 2 from the portion of the outer periphery of the funnel 3 linked to the neck component 5.

As shown in FIG. 3, the panel 2 is symmetrical to a horizontal axis 2*a* (H axis) and a vertical axis 2*b* (V axis) that are perpendicular to each other. The three electron beams emitted from the electron gun 8 are deflected by the deflection yoke 9 in the direction of the horizontal axis 2*a* and the vertical axis 2*b* of the panel 2. The electron beams pass through electron beam passage holes in the shadow mask 7 disposed on the inside of the panel 2, and land on the screen 6, thereby producing a specific image.

As shown in FIG. 2, the cathode ray tube has a deflection angle $\theta$ corresponding to the model. The deflection angle $\phi$ is the maximum deflection angle of electron beams reaching diagonal ends 6*a* and 6*b* (FIGS. 2 and 3), which are the maximum diameter positions of the screen 6.

The deflection angle is related to the reference line 12 (deflection reference position). This reference line is a line that is perpendicular to the tube axis 1*a* and passes through a point 14 (deflection center) on the tube axis, which is such that the angle formed by two straight lines linking to any point on the tube axis 1*a* (Z axis) from the diagonal ends 6*a* and 6*b* (FIGS. 2 and 3) of the screen 6 is the same as the deflection angle $\theta$ of that cathode ray tube.

Figure 4A:
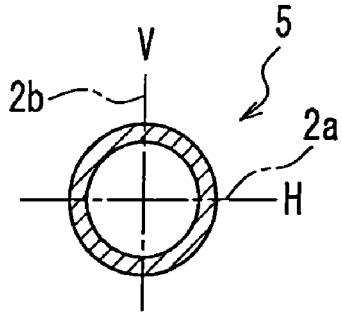
FIG. 4A is a cross-sectional view of the vacuum envelope according to an embodiment of the present invention, made near a linking component 11.
Figure 4B:
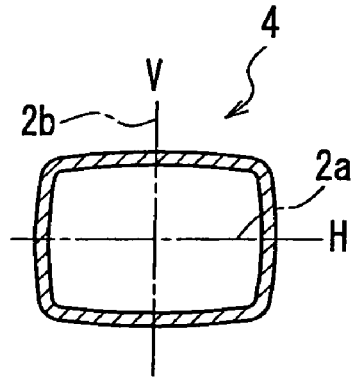
FIG. 4B is a cross-sectional view of the vacuum envelope according to an embodiment of the present invention, made at the position of a reference line 12.
Figure 4C:
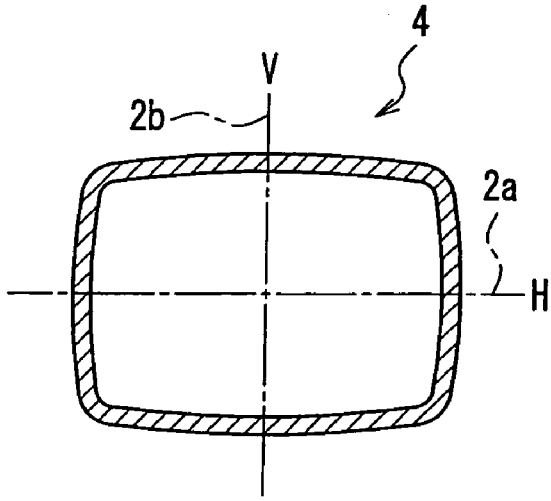
FIG. 4C is a cross-sectional view of the vacuum envelope according to an embodiment of the present invention, made near a linking component 13.

FIGS. 4A, 4B, and 4C are cross-sectional views of the cone component 4 in the direction perpendicular to the tube axis of the vacuum envelope 10 shown in FIG. 2. FIG. 4A is a cross-sectional view near the portion 11 linking the neck component 5 and the cone component 4, FIG. 4B is a cross-sectional view at the position of the reference line 12, and FIG. 4C is a cross-sectional view near the portion 13 linking the cone component 4 and the funnel 3. It can be seen from these drawings that the cone component 4 where the deflection yoke 9 is installed is substantially pyramidal in shape.

More specifically, as shown in FIG. 4A, near the linking portion 11, the cone component 4 is circular, having substantially the same shape as the neck component 5. From near the reference line 12 shown in FIG. 4B to the linking portion 13 shown in FIG. 4C, the shape is substantially rectangular (non-circular), having a maximum diameter near the diagonal axis.

The deflection yoke 9 here is usually a saddle/saddle type in which both the horizontal and vertical deflection coils are saddle types, but may have any of various configurations, such as a semitoroidal deflection yoke in which the horizontal deflection coil is a saddle type and the vertical deflection coil is toroidal, or a toroidal deflection yoke in which the horizontal and vertical deflection coils are both toroidal.

Figure 5:
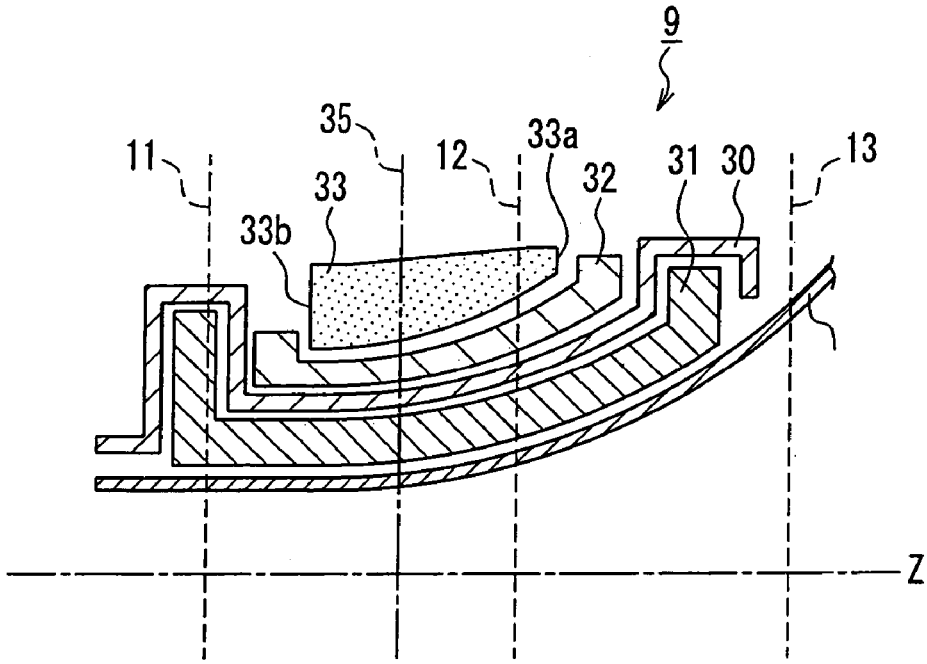
FIG. 5 is a cross-sectional view of an example of a saddle/saddle type of deflection yoke.

FIG. 5 is a cross-sectional view of an example of a saddled saddle type of deflection yoke. A separator 30 is a pyramidal insulator that conforms substantially to the outer periphery of the cone component 4. The horizontal deflection coil 31 and the vertical deflection coil 32 are insulated via the separator 30.

The horizontal deflection coil 31 is disposed on the inside of the separator 30, and is a coil wound around a pair of substantially pyramidal saddle shapes so as to correspond to the shape of the separator 30. The vertical deflection coil 32 is disposed on the outside of the separator 30, and is a coil wound around a pair of saddle shapes. A core 33 is disposed on the outside of the vertical deflection coil 32 so as to cover this coil. The core 33 is a truncated conical or truncated pyramidal magnetic body.

As discussed above, when the cone component 4 is formed in a pyramidal shape, rather than its ordinary circular shape, the inside diameter of the diagonal corners where an electron beam is likely to collide (near the diagonal axis: near the D axis) is increased, thereby avoiding collision of electron beams. Deflection power also can be reduced by decreasing the inside diameters in the horizontal axis H and vertical axis V directions, so that the horizontal and vertical deflection coils of the deflection yoke are closer to the electron beams, allowing the electron beams to be deflected more efficiently.

Specifically, deflection power is related to the distance between the tube axis and a point on the horizontal axis on the inner surface of the deflection yoke, and to the distance between the tube axis and a point on the vertical axis on the inner surface of the deflection yoke. Also, the path of the electron beams passing near the diagonal corners out of the inner surface of the deflection yoke is determined by the horizontal deflecting magnetic field and the vertical deflecting magnetic field of the deflection yoke.

In FIG. 5, 35 is the position on the deflection yoke 9 of maximum magnetic field intensity. Magnetic field intensity is greatest near the maximum magnetic field intensity position 35. When we use the screen edge 33*a* of the core 33 as a reference, the maximum magnetic field intensity position 35 is a position that is away from the screen edge 33*a* in the direction of the neck edge 33*b* by two-thirds the distance from the screen edge 33*a* to the neck edge 33*b*.

The maximum magnetic field intensity position 35 of the deflection yoke 9 is located to the neck side from the reference 12 position that determines the deflection angle of the cathode ray tube, and is approximately located up to 30 mm from the reference line 12 toward the neck.

As discussed above, preventing beam neck shadow and reducing deflection power are related to the shape of the cone component, and in particular to the shape near the maximum magnetic field intensity position 35. Accordingly, beam neck shadow can be prevented efficiently by suitably setting the angle formed by the horizontal axis and the maximum diameter of the cross sectional shape perpendicular to the tube axis of the cone component near the maximum magnetic field intensity position 35. Further, deflection power can be reduced efficiently by minimizing the distance of the cone component from the tube axis on the vertical axis and the horizontal axis.

Figure 6:
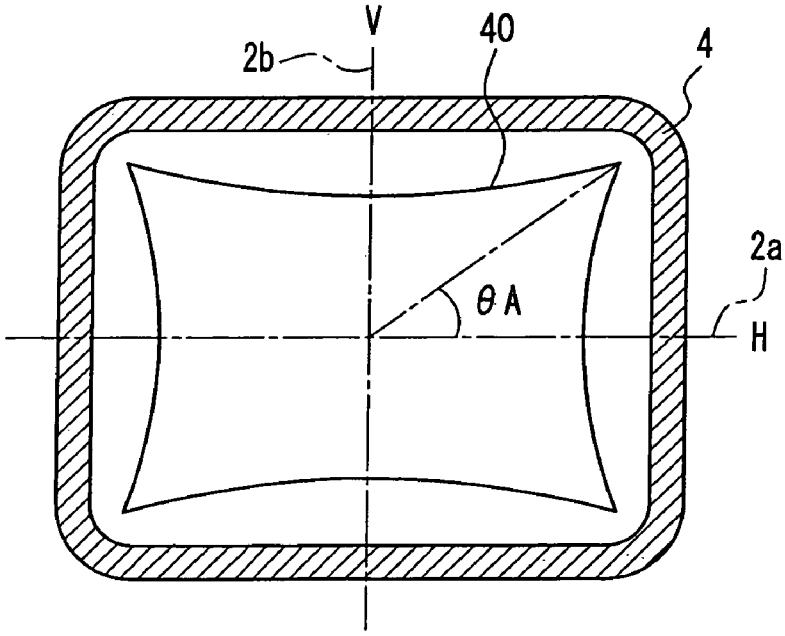
FIG. 6 is a diagram of the range of the path of the electron beams passing through a cone component 4 during display on the screen.

FIG. 6 is a diagram of the range of the path of the electron beams passing through the cone component 4 during display on the screen. This diagram is a cross-sectional view in the direction perpendicular to the tube axis of the cone component 4. 40 is the region through which the electron beams pass. The electron beams deflected within the electron beam passage region 40 are deflected and scanned horizontally and vertically over the rectangular region in which the aspect ratio of the fluorescent screen is M:N.

It can be seen that the electron beam passage region 40 is highly distorted into a pincushion shape, and that there is not as much leeway in the distance to the electron beams in the areas near the diagonal corners of the inner surface of the cone component 4 as there is near the intersection of the horizontal axis 2*a* and the vertical axis 2*b* of the inner surface of the cone component 4.

Figure 7A:
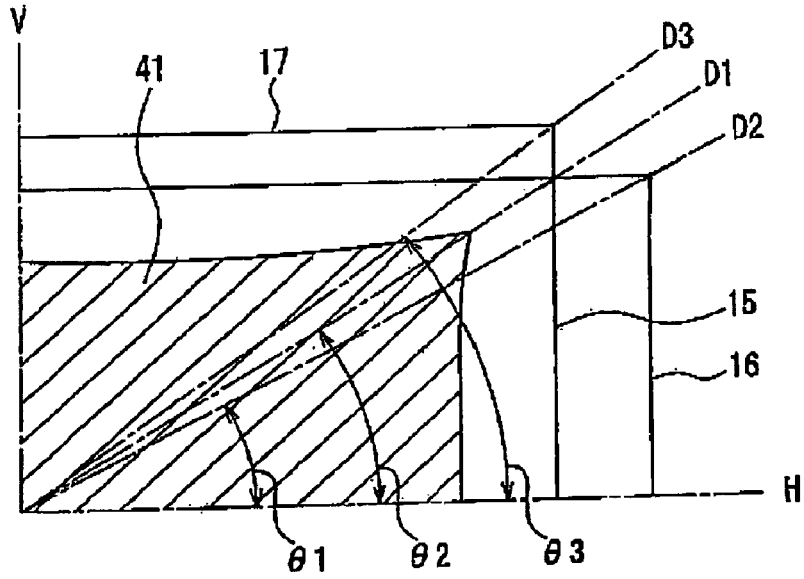
FIG. 7A is a diagram of an example of the simplified shape of the inner surface of the cone component.

FIG. 7A illustrates an example of the simplified shape of the inner surface of the cone component. 41 is the electron beam passage region. This shows cone component inner surfaces 15, 16, and 17 as three examples of the cone component inner surface shape. The cone component inner surface 15 is such that the angle formed by the horizontal axis H and the axis D1 in the maximum diameter direction is θ2. The cone component inner surface 15 is an example of preventing beam neck shadow, ensuring good air pressure resistance, and optimizing deflection power as well.

The cone component inner surface 16 is such that the angle formed by the horizontal axis H and the axis D2 in the maximum diameter direction is θ1 (θ1<θ2). Accordingly, the cone component inner surface 16 is shaped more laterally rectangular than the cone component inner surface 15. In this case, the length in the maximum diameter direction is greater than that of the cone component inner surface 15, which is advantageous in terms of preventing beam neck shadow. On the other hand, the distance between the electron beam passage region 41 and the deflection yoke in the horizontal axis H direction is greater, which decreases the efficiency of the horizontal deflection magnetic field, so that deflection power is higher than with the cone component inner surface 15.

The cone component inner surface 17 is such that the angle formed by the horizontal axis H and the axis D3 in the maximum diameter direction is θ3 (θ2<θ3). Accordingly, the cone component inner surface 17 is shaped more laterally rectangular than the cone component inner surface 15. In this case, the length in the maximum diameter direction is greater than that of the cone component inner surface 15, which is advantageous in terms of preventing beam neck shadow. On the other hand, the distance between the electron beam passage region 41 and the deflection yoke in the vertical axis V direction is greater, which decreases the efficiency of the vertical deflection magnetic field, so that deflection power is higher than with the cone component inner surface 16.

Figure 7B:
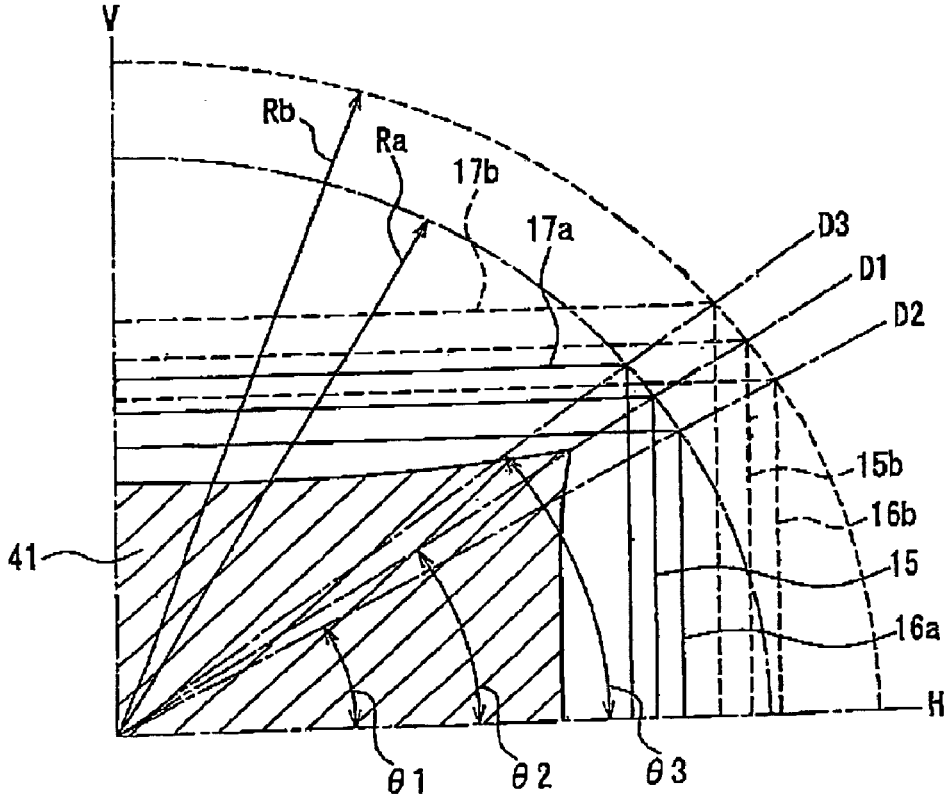
FIG. 7B is a diagram of another example of the simplified shape of the inner surface of the cone component.

FIG. 7B shows other examples of the cone component inner surface. The cone component inner surface 15 corresponds to the cone component inner surface 15 in FIG. 7A. A cone component outer surface 15*b* is an outer surface shape corresponding to the cone component inner surface 15.

A cone component inner surface 16*a* is an inner surface shape in which the angle formed by the horizontal axis and the axis D2 in the maximum diameter direction is θ1, which is smaller than θ2, and the maximum diameter Ra of the cone component inner surface 15 is maintained.

When we let the cone component outer surface 15*b* be the outer surface shape for both the cone component inner surface 16*a* and the cone component inner surface 15, then the conditions for both are the same in regard to deflection power. However, while the maximum diameter Ra is the same for both shapes, the cone component inner surface 16*a* is closer to the electron beam passage region 41 than the cone component inner surface 15 in the vertical axis V direction, which is disadvantageous in terms of beam neck shadow.

Viewed in the horizontal axis H direction, the cone component inner surface 16*a* approaches the cone component outer surface 15*b*, the wall thickness in the horizontal direction decreases, and air pressure resistance deteriorates. In this case, it is possible for the outer surface shape corresponding to the cone component inner surface 16*a* to be the cone component outer surface shape 16*b* in order to ensure adequate air pressure resistance. The cone component outer surface shape 16*b* is a shape in which the maximum outside diameter is matched to the maximum outside diameter Rb of the cone component outer surface shape 15*a*. When the cone component outer surface shape 16*b* is employed, the wall thickness can be greater in the horizontal direction, but the outer shape grows larger in the horizontal direction, so that there is an increase in horizontal deflection power.

A cone component inner surface 17*a* is an inner surface shape in which the angle formed by the horizontal axis and the axis D2 in the maximum diameter direction is θ3, which is greater than θ2, and the maximum diameter Ra of the cone component inner surface 15 is maintained.

When we let the cone component outer surface 15*b* be the outer surface shape for both the cone component inner surface 17*a* and the cone component inner surface 15, then the conditions for both are the same in regard to deflection power. However, while the maximum diameter Ra is the same for both shapes, the cone component inner surface 17*a* is closer to the electron beam passage region 41 than the cone component inner surface 15 in the horizontal axis H direction, which is disadvantageous in terms of beam neck shadow.

Viewed in the vertical axis V direction, the cone component inner surface 17*a* approaches the cone component outer surface 15*b*, the wall thickness in the vertical direction decreases, and air pressure resistance deteriorates. In this case, it is possible for the outer surface shape corresponding to the cone component inner surface 17*a* to be the cone component outer surface shape 17*b* in order to ensure adequate air pressure resistance. The cone component outer surface shape 17*b* is a shape in which the maximum outside diameter is matched to the maximum outside diameter Rb of the cone component outer surface shape 15*a*. When the cone component outer surface shape 17*b* is employed, the wall thickness can be greater in the vertical direction, but the outer shape grows larger in the vertical direction, so that there is an increase in vertical deflection power.

We can conclude from the above that the angle formed by the horizontal axis and the axis in the maximum diameter direction of the cone component inner surface is a factor in the design of the cone component shape that serves as a reference in preventing beam neck shadow, reducing deflection power, and ensuring adequate air pressure resistance. Specifically, when this angle is within the specified range, it will be possible to determine the cone component shape that will prevent beam neck shadow, reduce deflection power, and ensure adequate air pressure resistance, but outside this specified range, a cone component shape that satisfies all these requirements will not be obtained.

Figure 8:
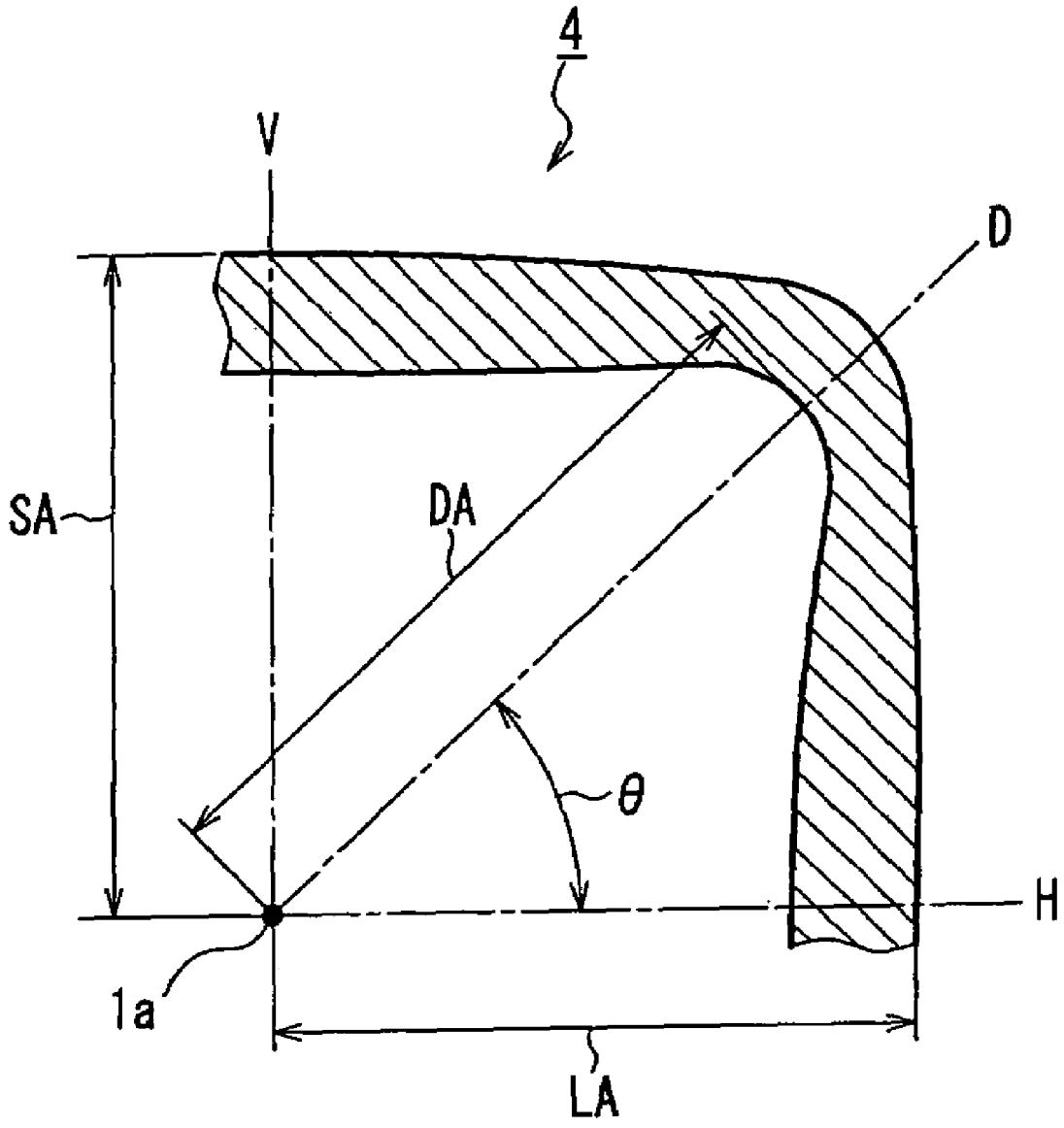
FIG. 8 is a partial cross-sectional view of the cone component 4 according to an embodiment of the present invention, in a direction perpendicular to the tube axis 1*a;*

FIG. 8 is a partial cross-sectional view of the cone component 4 in an embodiment of the present invention, in a direction perpendicular to the tube axis 1*a*. To move the deflection yoke closer to the electron beam efficiently, to reduce deflection power, the outer surface of the cone component is shaped to conform roughly to the inner surface shape of the deflection yoke. This cross-sectional view shows a coordinate system in which the tube axis 1*a* of the cone component includes the origin and the horizontal axis H and the vertical axis V intersect at right angles. We will let LA be the horizontal radius, which is the radius on the horizontal axis H of the outer surface of the cone component 4, SA be the vertical radius, which is the radius on the vertical axis V of the outer surface of the cone component 4, and DA be the maximum diameter of the outer surface of the cone component 4.

Also, we will let θ be the angle formed by the horizontal axis H and the axis D in the maximum diameter DA direction of the inner surface of the cone component 4, and N/M be the ratio (screen aspect ratio) of the vertical diameter and horizontal diameter of the screen. Further, we will assume the position in the tube axis direction to be such that the reference line position that serves as a reference for the deflection angle is zero, and is positive on the screen side.

Figure 10:
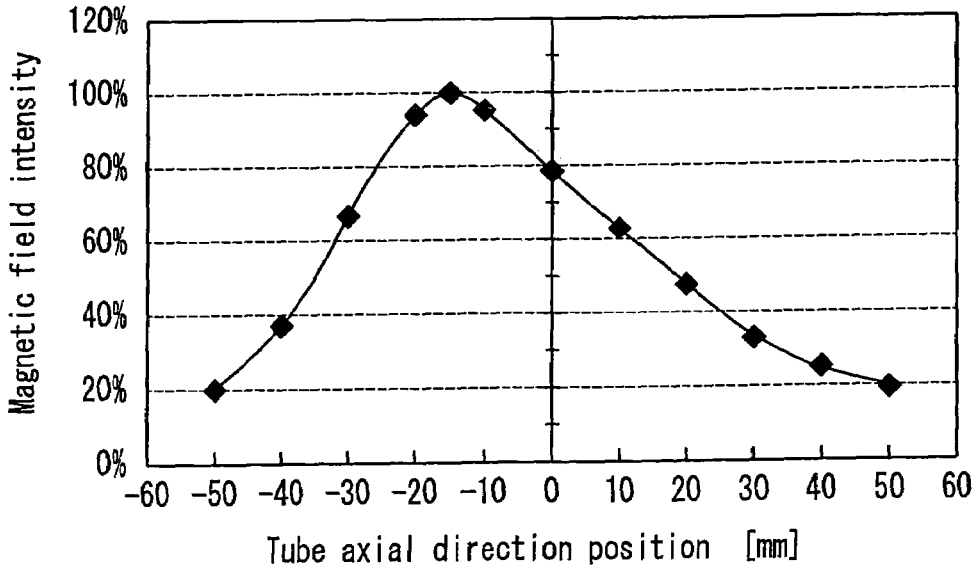
FIG. 10 is a graph of the magnetic field intensity distribution of the deflection yoke of a color receiver with a 76-cm screen aspect ratio of 16:9.

The angle θ is expressed by Formula 1 below, in which LA and SA at position Z on the tube axis are given as LA(Z) and SA(Z). The range of Z, as described below through reference to FIG. 10, is −30 mm≦Z≦10 mm, at which the magnetic field intensity of the deflection yoke is high and there is a maximum magnetic field intensity.

$$\theta=\tan^{-1}[(N/M)\times(LA(Z)/SA(Z))] \qquad \text{Formula 1}$$

In FIG. 8, when the cone component outer surface is such that LA/SA>1, that is, with a laterally rectangular shape in which the length of the horizontal sides is the horizontal radius LA and the length of the vertical sides is the vertical radius SA, the deflection yoke is farther away from the electron beam in the horizontal axis E direction, and vertical deflection relatively plays a greater role than horizontal deflection in the deflection of the electron beam. Therefore, in the electron beam passage region 40 shown in FIG. 6, the angle θA of the maximum diameter in the diagonal angle direction goes toward the vertical axis V side and is increased.

Accordingly, the angle of this maximum diameter is greater than the angle $\theta B=\tan^{-1}(N/M)$ calculated from the aspect ratio of the screen. Therefore, when the angle θ formed by the horizontal axis and the maximum diameter of the cone component inner surface shape is determined to be the angle θB, since the angle θB is smaller than the angle θA, this is disadvantageous in terms of preventing beam neck shadow.

The above-mentioned Formula 1 is a formula for calculating the angle θ by multiplying (N/M) by LA(Z)/SA(Z), which is greater than 1. Accordingly, the angle θ increases as LA(Z)/SA(Z) increases, that is, as the proportion of laterally rectangular became larger. Specifically, the angle θ can be considered a value obtained by correcting the above-mentioned angle θB, which is calculated from the screen aspect ratio, according to the proportion of laterally rectangular of the cone component, and is advantageous in terms of preventing beam neck shadow.

Table 1 below gives specific examples of the angle θ calculated with Formula 1. The examples in Table 1 are for a color receiver with an 80-cm screen having an aspect ratio of 4:3.

TABLE 1

| Z (mm) | LA (mm) | SA (mm) | LA/SA | θ (°) |
|---|---|---|---|---|
| 10 | 38.1 | 30.5 | 1.25 | 43.1 |
| 0 | 29.6 | 24.7 | 1.20 | 41.9 |
| −15 | 21.0 | 19.3 | 1.09 | 39.2 |
| −20 | 19.0 | 18.0 | 1.06 | 38.4 |
| −30 | 16.3 | 16.2 | 1.01 | 37.0 |

Figure 9:
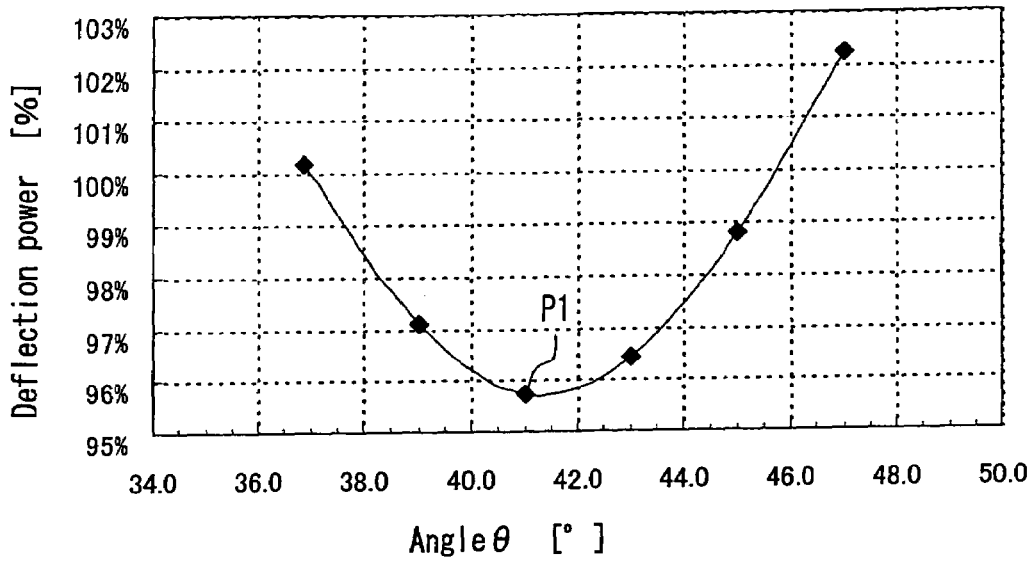
FIG. 9 is a graph of experimental values for the relation between deflection power and the angle θ in a color receiver with an 80-cm screen aspect ratio of 4:3.

FIG. 9 is a graph of experimental values for the relation between deflection power and the angle θ in a color receiver with an 80-cm screen aspect ratio of 4:3. The deflection power on the vertical axis was set to a target value of 100%. The angle θ on the horizontal axis is the angle at the reference line position (Z=0 mm).

FIG. 10 shows the magnetic field intensity distribution of the deflection yoke of a color receiver with a 76-cm screen aspect ratio of 16:9. As shown in FIG. 10, the maximum magnetic field intensity of the deflection yoke is at tube axial direction position Z=−15 mm. When we let the maximum magnetic field intensity be 100%, then the range of −30 mm≦Z≦10 mm can be considered a range in which the magnetic field intensity is relatively high (at least 60%).

FIG. 10 shows an example of a 76-cm screen with an aspect ratio of 16:9, but the position of the maximum magnetic field intensity and the range in which the magnetic field intensity is relatively high will be the same regardless of the receiver size or aspect ratio.

A comparison of the calculated results in Table 1 with the experimental results in FIG. 9 reveals that the angle θ in Table 1 is within the range of 37.0°≦θ≦43.1°, while the angle θ in FIG. 9 reaches the target value (100%) for deflection power within the range of 36.9°≦θ≦45.7°. Specifically, the range of angle θ calculated with Formula 1 is within the range of angle θ at which the target value for deflection power can be attained.

The angle θ in FIG. 9 is the angle at the reference line position, but as shown in Table 1, setting the angle θ to within the range of 36.9°≦θ≦45.7° can be considered effective for reducing deflection power not only at the reference line position, but over the entire range of −30 mm≦Z≦10 mm at which magnetic field intensity is high. This applies to the relationship between FIG. 11 and Table 2, which will be described later.

When the magnetic field intensity shown in FIG. 10 is at its maximum (Z=−15 mm), the calculated value for θ in Table 1 is 39.2°. The range from the position where magnetic field intensity is at its maximum toward the screen side is the range in which there is greater deflection of the electron beams, and is therefore important in preventing beam neck shadow. A reference line position expressed as the center of the deflection magnetic field is within this range. With the examples in Table 1, the angle θ at the reference line position (Z=0 mm) is 41.9°.

Therefore, with the examples in Table 1, in the range from the position where magnetic field intensity is at its maximum (Z=−15 mm) to the reference line position (Z=0 mm), the angle θ is from 39.2° to 41.9°. These values substantially match the angle θ=41° given in the experimental results in FIG. 9, at which the deflection power is at its minimum P1. Specifically, Formula 1 can be used to calculate the angle θ at which the deflection power is at its optimal value.

Here, in the example of Table 1, LA(Z)/SA(Z) is expressed by Formula 2 below.

$$1.01 \leqq LA(Z)/SA(Z) \leqq 1.25 \quad \text{Formula 2}$$

From this, when the LA(Z)/SA(Z) is within the range that satisfies Formula 2, it can be said that the angle θ calculated from Formula 1 can determine the shape at which the deflection power is at its optimal value. Furthermore, as described above, it can be said that the angle θ is calculated based on Formula 1, so that this angle is a value corrected so as to be advantageous to prevent beam neck shadow.

Therefore, the angle θ determined in the range satisfying Formula 2 can be a value satisfying both the beam neck shadow and the deflection power, and corresponds to the vicinity of the angle θ2 in FIGS. 7A and 7B. Accordingly, a shape that can ensure the wall thickness can be determined and air pressure resistance can be ensured.

Meanwhile, when the value of LA(Z)/SA(Z) is too large (over the upper limit of Formula 2 above), the angle θ of the inner surface shape also will be too large. The inner surface shape determined by the angle θ in this case corresponds to the inner surface 17 in FIG. 7A and the inner surface 17*a* in FIG. 7B, and as discussed above, when based on one of these shapes, the obtained cone component shape will not satisfy the requirements of preventing beam neck shadow, reducing deflection power, and ensuring good air pressure resistance. A case in which (M/N)<LA(Z)/SA(Z)) corresponds to this situation, for instance.

When the value of LA(Z)/SA(Z) is too small (under the lower limit of Formula 2 above), the angle θ of the inner surface shape also will be too small. The inner surface shape determined by the angle θ in this case corresponds to the inner surface 16 in FIG. 7A and the inner surface 16*a* in FIG. 7B, and as discussed above, when based on one of these shapes, the obtained cone component shape will not satisfy the requirements of preventing beam neck shadow, reducing deflection power, and ensuring good air pressure resistance.

The examples in Table 1 are for a screen with an aspect ratio of 4:3, whereas Table 2 gives examples for a color receiver with a 76-cm screen aspect ratio of 16:9.

TABLE 2

| Z (mm) | LA (mm) | SA (mm) | LA/SA | θ (°) |
|---|---|---|---|---|
| 10 | 41.7 | 33.3 | 1.25 | 35.2 |
| 0 | 33.2 | 27.4 | 1.21 | 34.3 |
| −15 | 23.0 | 20.0 | 1.15 | 32.9 |
| −20 | 20.3 | 18.3 | 1.11 | 32.0 |
| −30 | 16.5 | 15.8 | 1.04 | 30.4 |

Figure 11:
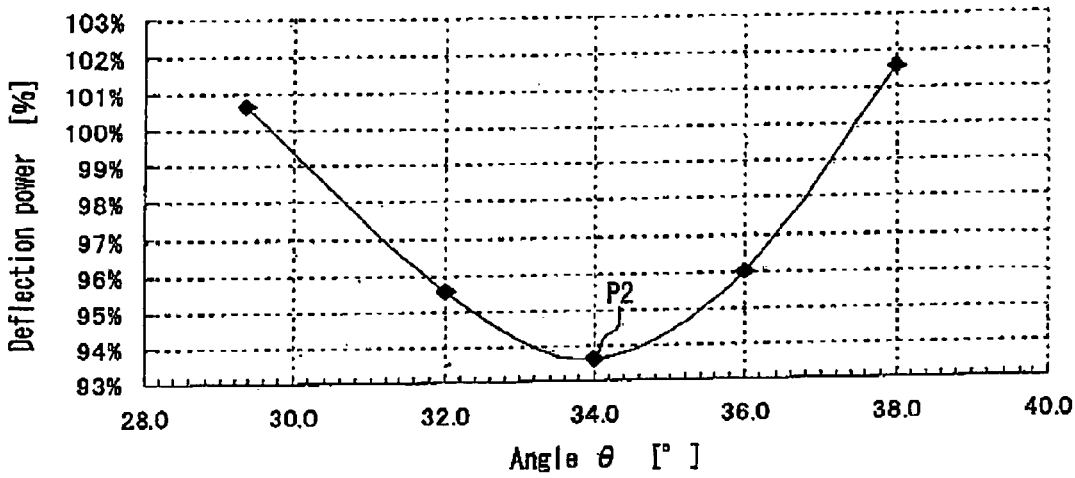
FIG. 11 PRIOR ART
FIG. 11 is a graph of experimental values for the relation between deflection power and the angle θ in a color receiver with an 76-cm screen aspect ratio of 16:9.
Figure 12:
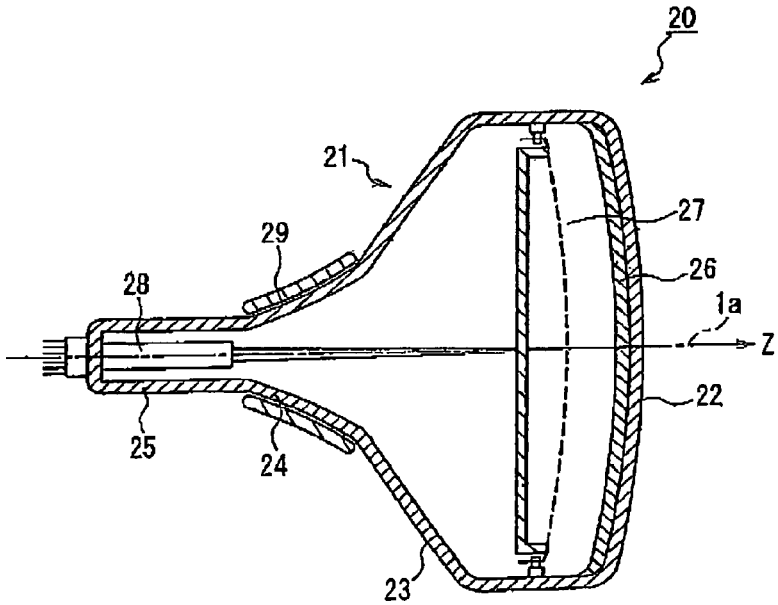
FIG. 12 is a cross-sectional view of an example of a conventional cathode ray tube.

Next, FIG. 11 is a graph of experimental values for the relation between deflection power and the angle θ in a color receiver with a 76-cm screen aspect ratio of 16:9. The deflection power on the vertical axis was set to a target value of 100%. The angle θ on the horizontal axis is the angle at the reference line position (Z=0 mm).

A comparison of the calculated results in Table 2 with the experimental results in FIG. 11 reveals that the angle θ in Table 2 is within the range of 30.4°≦θ≦35.2°, while the angle θ in FIG. 11 reaches the target value (100%) for deflection power within the range of 29.6°≦θ≦37.4°. Specifically, the range of angle θ calculated with Formula 1 is within the range of angle θ at which the target value for deflection power can be attained.

With the examples in Table 2, in the range from the position where magnetic field intensity is at its maximum (Z=−15 mm) to the reference line position (Z=0 mm), the angle θ is from 32.9° to 34.3°. These values substantially match the angle θ=34; given in the experimental results in FIG. 11, at which the deflection power is at its minimum P2. Therefore, again with examples in which the aspect ratio is different, when LA(Z)/SA(Z) is within a specific range, Formula 1 can be used to calculate the angle θ at which the deflection power is at its optimal value.

With the examples in Table 2, LA(Z)/SA(Z) is within the range of 1.04 to 1.25. When LA(Z)/SA(Z) is within this range, then just as when the aspect ratio is 4:3, the angle θ calculated with Formula 1 can be used to determine the cone component shape at which deflection power can be reduced, beam neck shadow can be prevented, and good air pressure resistance can be ensured.

The range of LA(Z)/SA(Z) in the examples in Table 2 is included in the range of Table 2. The lower limit to Formula 2 is 1.01, and when the lower limit in the examples in Table 2 is expanded to 1.01, and the angle θ is calculated from Formula 1, the result is θ=29.6°. This value corresponds to the lower limit of the angle θ at which the target value (100%) for deflection power can be attained.

Therefore, even when the aspect ratio and screen size are different, as long as LA(Z)/SA(z) is within the range of Formula 2, the angle θ calculated with Formula 1 can be used to determine the cone component shape at which deflection power can be reduced, beam neck shadow can be prevented, and good air pressure resistance can be ensured. Accordingly, the present invention can be applied to various screen sizes and various aspect ratios.

As discussed above, the range from the position where magnetic field intensity is at its maximum (Z=−15 mm) toward the screen side including the reference line position is the range in which there is greater deflection of the electron beams, and is therefore important in preventing beam neck shadow. Accordingly, the examples described in the above embodiment satisfied Formula 1 within the range of −30 mm≦Z≦10 mm, but it is preferable for Formula 1 to be satisfied over all or at least part of the range of −15 mm≦Z≦10 mm. It is also preferable for the range of Z to be −15 min≦Z≦5 mm so as to include at least the reference line position (Z=0 mm).

Also, the range of LA(Z)/SA(Z) corresponding to the range of −15 mm≦Z≦10 mm in Tables 1 and 2 is the range of the following Formula 3 for Table 1, and the range of the following Formula 4 for Table 2. As can be seen from FIGS. 9 and 11, the deflection power value is particularly good when the range of θ for each table corresponding to these ranges. Accordingly, LA(Z)/SA(Z) may be set to within the range of Formula 4 in which the ranges of Formulas 3 and 4 overlap.

$$1.01 \leqq LA(Z)/SA(Z) \leqq 1.25 \quad \text{Formula 3}$$

$$1.15 \leqq LA(Z)/SA(Z) \leqq 1.25 \quad \text{Formula 4}$$

Also, the greater is the deflection angle of an electron beam, the more likely it is that beam neck shadow will occur, and the greater is the deflection power. Accordingly, the present invention is particularly effective with a cathode ray tube having a large deflection angle. The deflection angle was 105° in the specific examples given above, but it was confirmed in separate experiments that it is even more effective to apply the present invention to a cathode ray tube with a deflection angle of at least 115°.

As above, with this embodiment, beam neck shadow can be prevented and deflection power reduced by determining the angle θ formed by the horizontal axis and the maximum diameter of the cone component inner surface near the position of the greatest magnetic field intensity of the deflection yoke, where the electron beams are deflected significantly.

With the present invention, good air pressure resistance can be ensured and beam neck shadow can be prevented while enhancing the effect of increasing the deflection efficiency of horizontal deflection, and thereby enhancing the effect of reducing deflection power, so the present invention is useful for cathode ray tubes used in television receivers, computer monitors, and so forth.

The embodiments described above are solely intended to illustrate the technological content of the present invention, and the present invention is not limited to or by these specific examples alone. Various modifications are possible within the scope of the claims and the spirit of the invention, and the present invention should be interpreted broadly.

What is claimed is:

1. A cathode ray tube, comprising:

a vacuum envelope equipped with an electron gun and including a panel component which has a fluorescent screen formed on a inner surface; and a deflection yoke disposed around the outer periphery of the vacuum envelope, for deflecting electron beams emitted from the electron gun, wherein the vacuum envelope includes a neck component in which the electron gun is installed, and a cone component corresponding to the position where the deflection yoke is disposed, the cross sectional shape of the cone component in a direction perpendicular to the tube axis of the cathode ray tube includes a non-circular cross sectional shape having its maximum diameter in a direction other than those of the major and minor axes of the panel, the screen aspect ratio, which is the ratio of the horizontal diameter to the vertical diameter of the fluorescent screen, is termed M:N, in a coordinate system in which the origin is a point on the tube axis and the horizontal axis and vertical axis intersect at right angles, LA is the radius of the outer surface of the cone component on the horizontal axis, SA is the radius on the vertical axis, and θ is the angle formed by the horizontal axis and the axis in the direction of the maximum diameter on the inner surface of the cone component, and when values of LA and SA are LA(Z) and SA(Z) when the position Z on the tube axis, using as its origin a reference line position that serves as a reference for a deflection angle, is within a range of $-30\ \text{mm} \leqq Z \leqq 10\ \text{mm}$, a portion is included such that the angle θ and the values of M, N, LA(Z), and SA(Z) satisfy the following relational formula $$\theta = \tan\left[(N/M) \times (LA(Z)/SA(Z))\right].$$

2. The cathode ray tube according to claim 1, wherein LA(Z)/SA(Z) in determining the angle θ is within the following range.

$$1.01 \leqq LA(Z)/SA(Z) \leqq 1.25.$$

3. The cathode ray tube according to claim 1, wherein LA(Z)/SA(Z) in determining the angle θ is within the following range.

$$1.15 \leqq LA(Z)/SA(Z) \leqq 1.25.$$

4. The cathode ray tube according to claim 1, wherein the angle θ and the values of M, N, LA(Z), and SA(Z) satisfy said relational formula within a range of $-30\ \text{num} \leqq Z \leqq 10$ mm.

5. The cathode ray tube according to claim 1, wherein, when ϕ is the maximum deflection angle of the electron beam that reaches the maximum diameter position of the fluorescent screen, then ϕ is within a range of $\phi \geqq 115°$.

6. The cathode ray tube according to claim 1, wherein the portion that satisfies the relational formula is such that the position Z is within a range of $-15\ \text{mm} \leqq Z \leqq 10\ \text{mm}$.

7. The cathode ray tube according to claim 6, wherein the angle θ and the values of M, N, LA(Z), and SA(Z) satisfy said relational formula within a range of $-15\ \text{mm} \leqq Z \leqq 10$ mm.

8. The cathode ray tube according to claim 6, wherein LA(Z)/SA(Z) in determining the angle θ is within the following range:

$$1.15 \leqq LA(Z)/SA(Z) \leqq 1.25.$$

9. The cathode ray tube according to claim 6, wherein, when ϕ is the maximum deflection angle of the electron beam that reaches the maximum diameter position of the fluorescent screen, then ϕ is within a range of $\phi \geqq 115°$.

* * * * *